US006934500B2

(12) United States Patent
Kowalski

(10) Patent No.: US 6,934,500 B2
(45) Date of Patent: Aug. 23, 2005

(54) FUSER RELEASE AGENT FLUID MANAGEMENT SYSTEM

(75) Inventor: Gregory L. Kowalski, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 22 days.

(21) Appl. No.: 10/667,557

(22) Filed: Sep. 22, 2003

(65) Prior Publication Data

US 2004/0120736 A1 Jun. 24, 2004

Related U.S. Application Data

(60) Provisional application No. 60/435,042, filed on Dec. 20, 2002.

(51) Int. Cl.[7] ..... G03G 15/20
(52) U.S. Cl. ..... 399/325
(58) Field of Search ..... 399/67, 324–326

(56) References Cited

U.S. PATENT DOCUMENTS 4,085,702 A * 4/1978 Consaul et al. ..... 399/325
5,708,914 A * 1/1998 Mills et al. ..... 399/325

FOREIGN PATENT DOCUMENTS

JP 54097046 A * 7/1979 ..... G03G/15/20
JP 60235176 A * 11/1985 ..... G03G/15/20
JP 2001265151 A * 9/2001 ..... G03G/15/20

* cited by examiner

*Primary Examiner*—Arthur T. Grimley
*Assistant Examiner*—Ryan Gleitz
(74) *Attorney, Agent, or Firm*—Lawrence P. Kessler

(57) ABSTRACT

A release agent fluid management system and methods of dispensing such fluid in fuser apparatus of image reproduction systems. The release agent fluid management system controllably applies release agent fluid to the fuser surface. A processor controls the amount of applied release agent fluid based on one or more image reproduction operating parameters.

13 Claims, 6 Drawing Sheets

FUSER RELEASE AGENT FLUID MANAGEMENT SYSTEM

CROSS REFERENCE TO RELATED APPLICATION

Reference is made to and priority claimed from U.S. Provisional Application Ser. No., 60/435,042 Filed on Dec. 20, 2002, entitled: FUSER RELEASE AGENT FLUID MANAGEMENT SYSTEM.

FIELD OF THE INVENTION

The present invention relates to systems for electrostatic printing and, more specifically, to systems and methods for distributing release agent fluids in fuser systems for electrostatic printers.

BACKGROUND OF THE INVENTION

In the process of electrophotography an image is recorded in the form of an electrostatic latent image on a photosensitive member. The latent image is then rendered optically visible by application of electroscopic marking particles commonly referred to as toner. The toner-based image may be affixed to the photosensitive member or may be transferred to another substrate and affixed thereto. The toner is commonly fixed or fused to the substrate by a combination of heat and pressure. That is, the temperature of the toner is elevated to a point at which elements of the toner become tacky such that these elements flow into fiber or pores or otherwise flow along the substrate surface. Thereafter, as the toner material cools, it solidifies and becomes bonded firmly to the substrate.

A conventional approach to heat and pressure fusing of electrostatic images on a support substrate, such as paper, involves passing the substrate with the toner images formed thereon between a pair of roller members at least one of which is heated. The heated member is commonly referred to as the fuser roller. Since the toner image is tackified by the heat, part of the intended image carried by the substrate surface may adhere to a portion of the fuser roller surface. As a second substrate surface is brought into contact with that same portion of the roller surface to receive a second intended image, the portion of the tackified first intended image that was partially transferred to the roller surface transfers to the second substrate surface.

During the same process, part of the tackified second image intended for the second substrate surface may also adhere to the heated roller such that an unintended image transfer again occurs. That is, with a portion of the tackified second intended image having been transferred to the roller surface, there is a partial transfer of the second image from a portion of the roller surface to a third substrate surface when a third image is being formed on the third substrate. Also, during revolution of the various roller members without a substrate coming into contact with the fuser roller, tackified toner which becomes affixed to the fuser roller may transfer to another roller, e.g., the pressure roller. Generally, such occurrences are referred to as "offset".

Particles of toner are offset, i.e., transferred, to the fuser roller for a variety of reasons, including insufficient heating, surface imperfections on the fuser roller or insufficient electrostatic forces to hold the toner particles against the substrate. Several solutions have been provided to mitigate this problem. Typically, the surface of the fuser roller is coated with a low-surface energy release agent fluid, such as silicone oil. Such release agent fluids are transferred to the fuser roller from a release agent (oil) sump, via a wick apparatus or a roller assembly. In the roller assembly, one or more roller surfaces are wet with the release agent and, through rolling action, the release agent is transferred to the fuser roller. See, for example, U.S. Pat. Nos. 6,075,966 and 6,112,045 each now incorporated herein by reference. It is desirable that such roller assemblies, referred to as oiler systems, pass a controlled and consistent amount of oil, i.e., release agent, to the fuser roller.

Despite numerous modifications and improvements made to such oiler systems, undesirable characteristics persist. For paper substrates, it is common to transfer some oil from the fuser roller to the sheet, e.g., four to eight mg per sheet of A4 paper. However, in multi-sheet printing operations it is not uncommon for the oil transfer rate to begin at three to four times the desired rate and to substantially decline after the first ten to twenty sheets are processed. This surge of release agent may be attributed to several factors. Residual release agent fluid is commonly left on the fuser roller surface from prior reproduction runs. The amount of such release agent fluid depends in part on the split ratio between rollers. With a simple 50 percent split in release agent fluid volume between rollers, the residual release agent fluid on the fuser roller can rise to four times the steady state rate.

In addition, if the oiler system remains idle for a significant time interval, e.g., five to ten minutes, some release agent fluid will migrate from the sump by capillary forces. With this accumulation in place, when the oiler system is next engaged a surge of release agent fluid, e.g., tens of mgs, will be transferred to the fuser roller and ultimately to the substrate.

Another factor affecting the volume of release agent fluid transferred is the viscosity of the release agent fluid, which, as is well known, varies substantially with temperature fluctuations. Thus, in systems which require thermal fusing of the toner, temperature variations are to be expected and such variations will have a temporal influence on viscosity. Predictably, the temperature of the release agent fluid is relatively low at the beginning of a reproduction run and increases as each sheet is processed during the run. While it is somewhat difficult to quantify the viscosity variation, limited tests indicate that normal heating can alter the viscosity to the point where, if other variables remain constant, the release agent fluid transfer rate may at least double.

The release agent fluid transfer rate is also affected by uncontrollable variations in roller speeds; particularly, in a roller assembly oiler system, the speed of a metering roller which is driven by a donor roller. When there is too much oil on the adjoining surfaces or there is excessive drag force caused by the wick of a wick apparatus, substantial slippage occurs. In turn, this results in slower movement of the metering roller. As the metering roller speed decreases, the amount of release agent fluid transferred to the donor roller also decreases. It should also be noted that, when there is a speed differential between the rollers, a drag force may persist which force can accelerate wear of the fuser roller.

The aforementioned variables are believed to result in non-uniform and somewhat unpredictable release agent fluid transfer rates. Further, notwithstanding these uncontrollable variations, such oiler systems are designed according to fixed release agent fluid transfer rates and do not have means for adjusting the release agent fluid transfer rates.

It is desirable to provide methods and systems, which improve the consistency and uniformity of transferring the release agent fluid. Such improvements would result in more satisfactory image reproduction and lower maintenance of associated equipment. It is also desirable to control the rate of release agent fluid transfer to the fuser roller. In conventional oiler system designs, one or more operating parameters may be selected to control the transfer rate, but because these are fixed for each design, there is a need for a system wherein the release agent fluid transfer rate is adjustable in order to further improve the quality of image reproduction.

SUMMARY OF THE INVENTION

The invention provides release agent fluid management (dispensing) systems and methods of managing dispensing of such release agent fluids in image reproduction electrostatic printers. According to one embodiment, a release agent fluid management system is associated with a fuser apparatus including a fuser roller having a cylindrically shaped surface formed about an axis of rotation. The fuser roller surface has a plurality of positions definable by angular position about the axis and measurable in an axial direction along the surface. The release agent fluid management system is configured to controllably transfer release agent fluid to the fuser roller surface. A controller unit is coupled to the release agent fluid management system to control the amount of release agent fluid transferred by the release agent fluid management system as a function of signals indicative of one or more image reproduction operating parameters.

In one illustration of the invention, the release agent fluid management system includes an atomization air source controlled by a controller to distribute selectable and differing amounts of release agent fluid upon different portions of the fuser roller surface according to signals to the controller unit received from a processor control system for an electrostatic printer. More specifically, the release agent management system may include a plurality of individually controllable microspray devices each configured to selectively apply release agent fluid to a portion of the fuser roller surface at a programmable selectable rate according to signals from the electrostatic printer processor control system indicative of one or more printer reproduction operating parameters, including data taken from the group consisting of substrate dimension, substrate type, image density, and fuser temperature and release agent viscosity.

A method is provided for controlling application of release agent fluid in an image reproduction system (electrostatic printer) that includes a fuser roller having a cylindrically shaped surface formed about an axis of rotation, with the surface having a plurality of positions definable by an angle of rotation about the axis. A release agent fluid management system sprays a variable amount of the release agent fluid which is transferred to the fuser roller. The amount of release agent sprayed is varied in response to one or more image reproduction operating parameters.

BRIEF DESCRIPTION OF THE DRAWINGS

The invention will be more fully understood when the following detailed description is read in conjunction with the drawings wherein.

Figure 1:
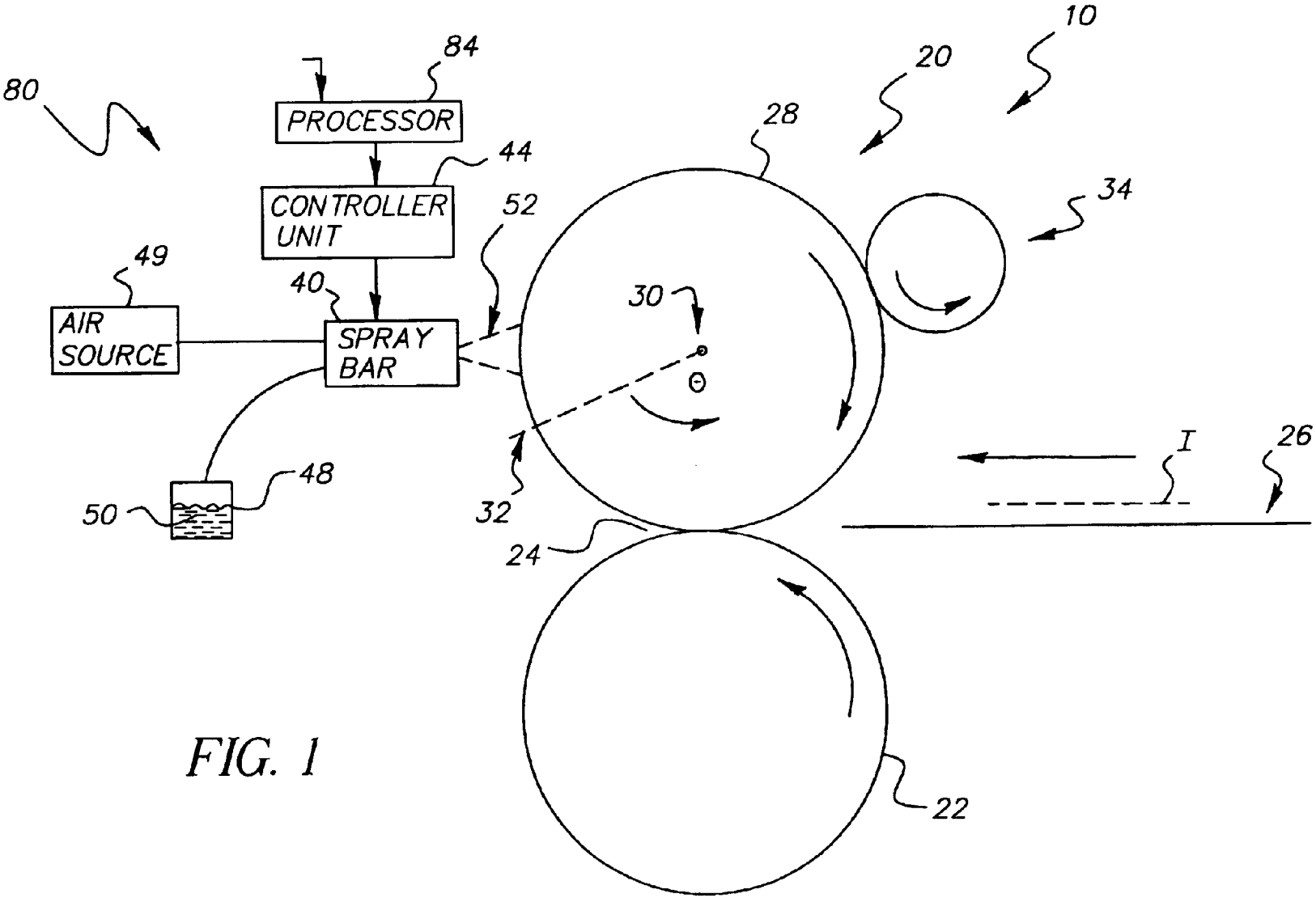
FIG. 1 illustrates a fuser apparatus for an image reproduction system, including a release agent fluid management system according to one embodiment of the invention.

In accord with common practice, the various illustrated features in the drawings are not to scale and may be drawn to emphasize specific features relevant to the invention. Moreover, the sizes of features may depart substantially from the scale with which these are shown. Reference characters denote like elements throughout the figures and the text.

DETAILED DESCRIPTION OF THE INVENTION

FIG. 1 illustrates components of an exemplary fuser apparatus 10 for an image reproduction system, including a release agent fluid management system 80, according to the invention. The fuser apparatus 10 includes a fuser roller 20 and an elastomeric pressure roller 22 which form a nip 24. A substrate 26, which in this example is a sheet of paper (but may be any of several other common forms of media), is directed through the nip 24 and comes in contact with the surface 28 of the fuser roller 20 to affix an image thereon by application of heat and pressure. At this stage of the reproduction process, a toner-based image I has been formed on the substrate 26. The toner becomes fused to the substrate 26 as it passes through the nip 24.

The surface 28 of the fuser roller 20 is cylindrically shaped and formed about an axis of rotation 30. Accordingly, positions on the surface 28 can be defined according to (a) measurement along the surface 28 in a direction parallel to the axis 30; and (b) an angle θ of rotation about the axis 30 relative to a reference position 32 on the surface 28.

As is well known in the art, heat for the fuser roller 20 may be provided by a lamp (not shown) mounted within the fuser roller, or the fuser surface 28 may be externally heated by other means such as a heated roller riding along and in contact with the fuser roller surface 28. It will be understood that, depending on the type of imaging material or toner applied to a substrate, it may be sufficient to apply pressure without heat to fuse the imaging material to the substrate. Although not required for all embodiments of the invention, a secondary roller 34 (as shown in FIG. 1) may be included to facilitate distribution or smoothing of an offset preventing release agent fluid applied to the fuser surface 28 as now described.

Figure 2:
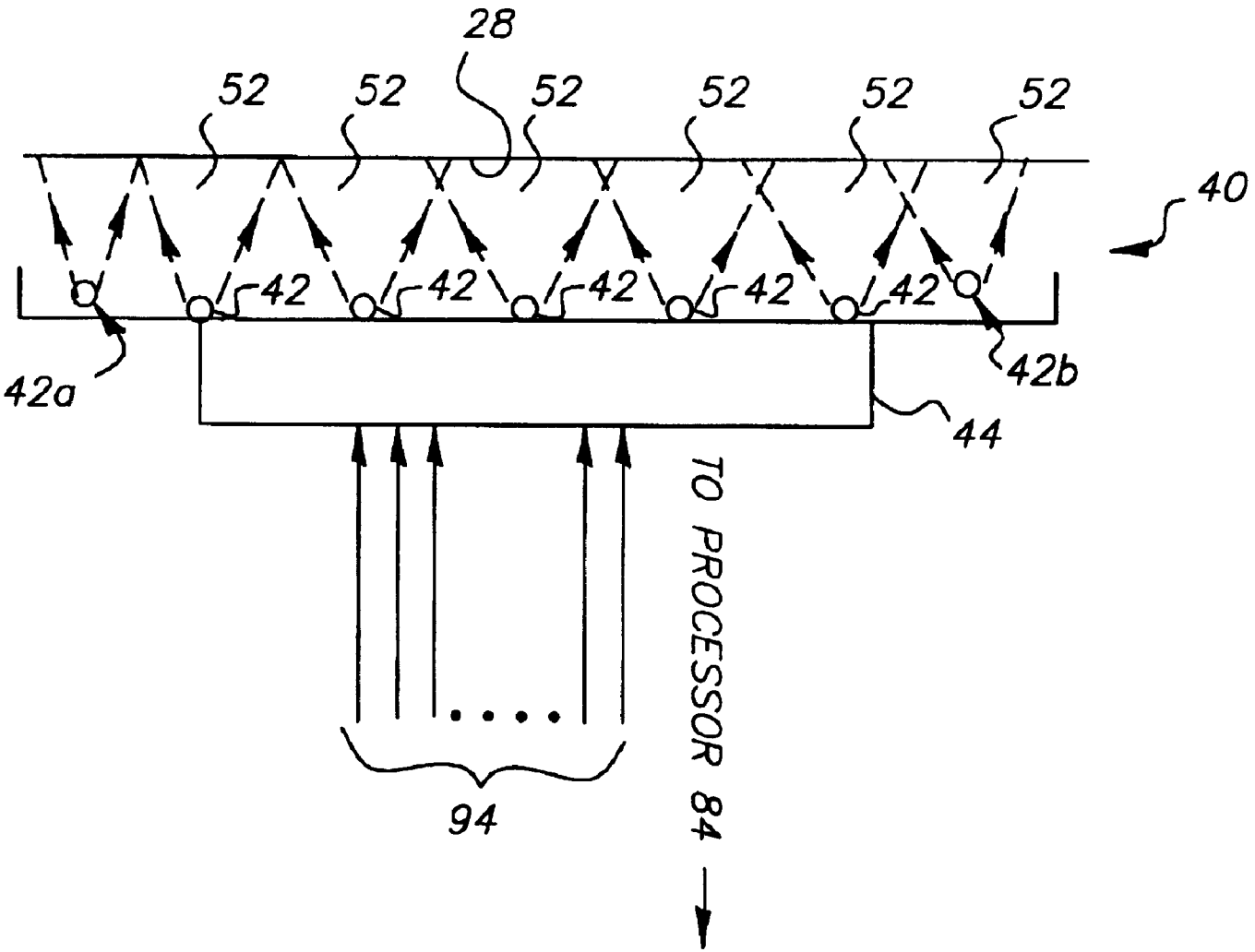
FIG. 2 illustrates a spray bar according to the invention as shown in FIG. 1.

Referring now to both FIG. 1 and the plan view of FIG. 2, as part of the release agent fluid management system 80, according to this invention, a spray bar 40 is positioned adjacent, and in spaced-apart relation to, the fuser roller surface 28. The spray bar 40 includes an array of microspray devices 42 and a controller unit 44. Each microspray device 42 has a conventional nozzle or orifice in combination with a solenoid (not illustrated) for impulsively delivering atomized sprays of release agent fluid according to signals received from the controller unit 44. A reservoir 48 containing release agent fluid, such as an offset preventing, silicone-based oil 50, supplies such oil to the spray bar 40 for distribution of the oil to each microspray device 42. The reservoir may be coupled to a low pressure (e.g., one bar), air source 49 to atomize the oil 50 to deliver the oil through the spray devices 42 to the surface 28 in desired patterns. A flat-pattern orifice is suitable for this purpose.

The controller unit 44 directs formation of conical patterned pulsed sprays 52 respectively from each microspray device 42 in order to apply the oil 50 to the fuser roller surface 28 in a pre-determinable manner. Preferably, the microspray devices 42 are of a type which may be repeatedly actuated at a high speed to provide consecutive spray pulses of adjustable duration and frequency. By way of example, when delivering the oil 50 under pressure, the controller may electronically switch each device 42 on and off at rates up to or in excess of 3000 times per minute.

During normal operating conditions, the oil 50 may undergo temperature variations between 60 and 250 degrees F., corresponding to a range in viscosity between 100 and 300 cP. Microspray devices 42 suitable for accommodating such fluid viscosities are available from Spraying Systems Co. of Wheaton, Ill. By way of example, such air atomizing nozzles may provide between 5 and 120 degree flat pattern spray angles to project the oil approximately 100 mm to the fuser roller surface 28. In the plan view of FIG. 2, the positional relations of numerous exemplary microspray devices 42 of the spray bar 40 are shown relative to one another and the fuser roller surface 28. Notably, adjacent ones of the devices 42 are spaced in sufficient proximity to one another to assure some overlap of the conical-patterned sprays 52 at the fuser roller surface.

Preferably, the array of sprays 52 spans a distance slightly greater than or equal to the maximum image width applied on the largest width substrate 26 that is to be accommodated by the fuser apparatus 10 for fixing such an image thereon. Although an array of seven microspray devices 42 is shown in the spray bar 40, more or fewer devices may be incorporated in accord with desired system capabilities, including the desired array width and desired level of resolution or control for application of the oil 50 to the substrate.

With reference to the cross sectional view of FIG. 1, the fuser roller surface 28 turns in a clockwise direction, while the pressure roller 22 in rolling engagement turns in a counterclockwise direction. The oil 50 is applied to the fuser roller surface 28 and is then smoothed by the roller 34 before reaching the nip 24. However, it is desired that application of the oil 50 to the fuser roller surface 28 is coordinated with the image on the substrate so that selected portions of the substrate 26 come into contact with selected amounts of oil on various portions of the fuser roller surface. Such variation in the amount of oil made available to different portions of the substrate 26 may be based on the amount of toner on the substrate surface, or may be based on the media (substrate) type, or may be based on another image-related operating parameter.

Figure 3:
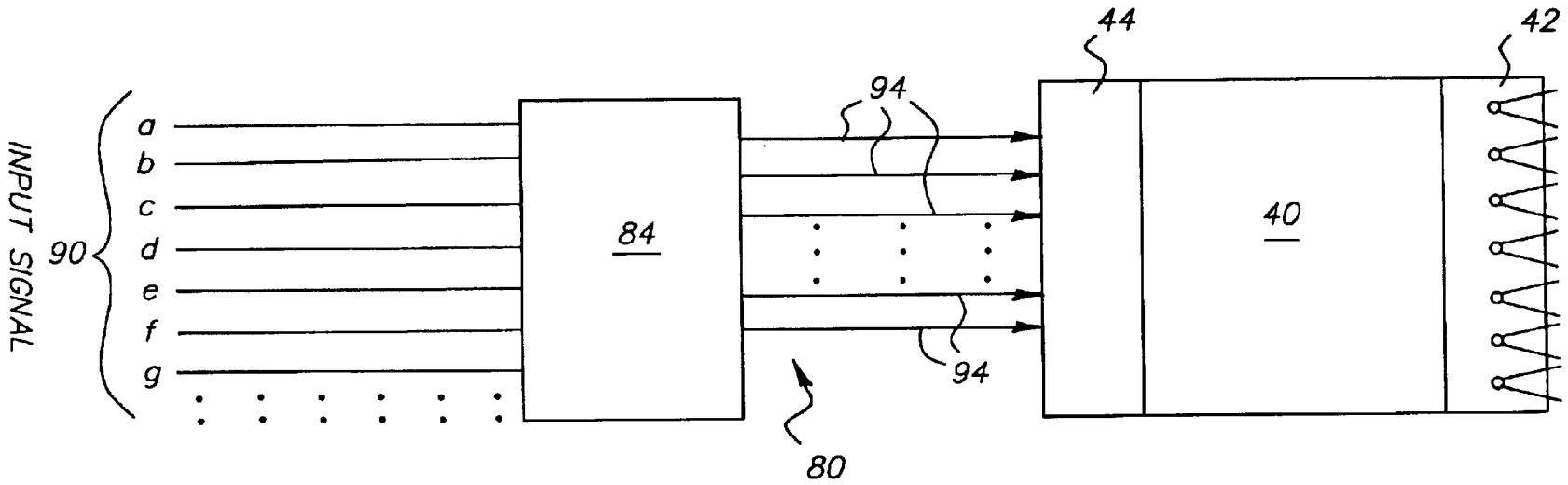
FIG. 3 illustrates the programmable release agent fluid management system according to the invention.

To effect such variation in oil application, the spray bar 40 is part of a programmable release agent fluid management system 80 for the image reproduction system fuser apparatus 10. As illustrated in FIG. 3, the system 80 also includes a processor 84, input lines 90 and control lines 94. Preferably the processor 84 is a microprocessor but it may be any suitable digital signal processor. The processor 84 receives input signals, for example along individual lines 90 (a, b, c, d, e, f, g . . . ), indicative of numerous operating parameters (and changes in each operating parameters) affecting image quality. For example, the processor 84 may receive data indicative of image toner content, image density, image position, substrate type, fuser roller position, fuser roller surface temperature, or oil conditions. The input parameters may also include a signal representative of the selection of one or two sided printing. In response, the processor 84 provides signals along the control lines 94 to the controller unit 44 to direct temporal variations in the amount of oil 50 sprayed by each microspray device 42. Thus, based on multiple input parameters, the release agent fluid management system 80, according to this invention, regulates the amount of oil distributed to portions of the fuser roller surface 28. Also, the release agent fluid management system 80 may control transfer of release agent fluid (oil 50) to the fuser roller surface 28 as a function of measurement along the fuser roller surface in the axial direction, i.e., in a direction along the surface parallel to the axis 30.

Figure 4:
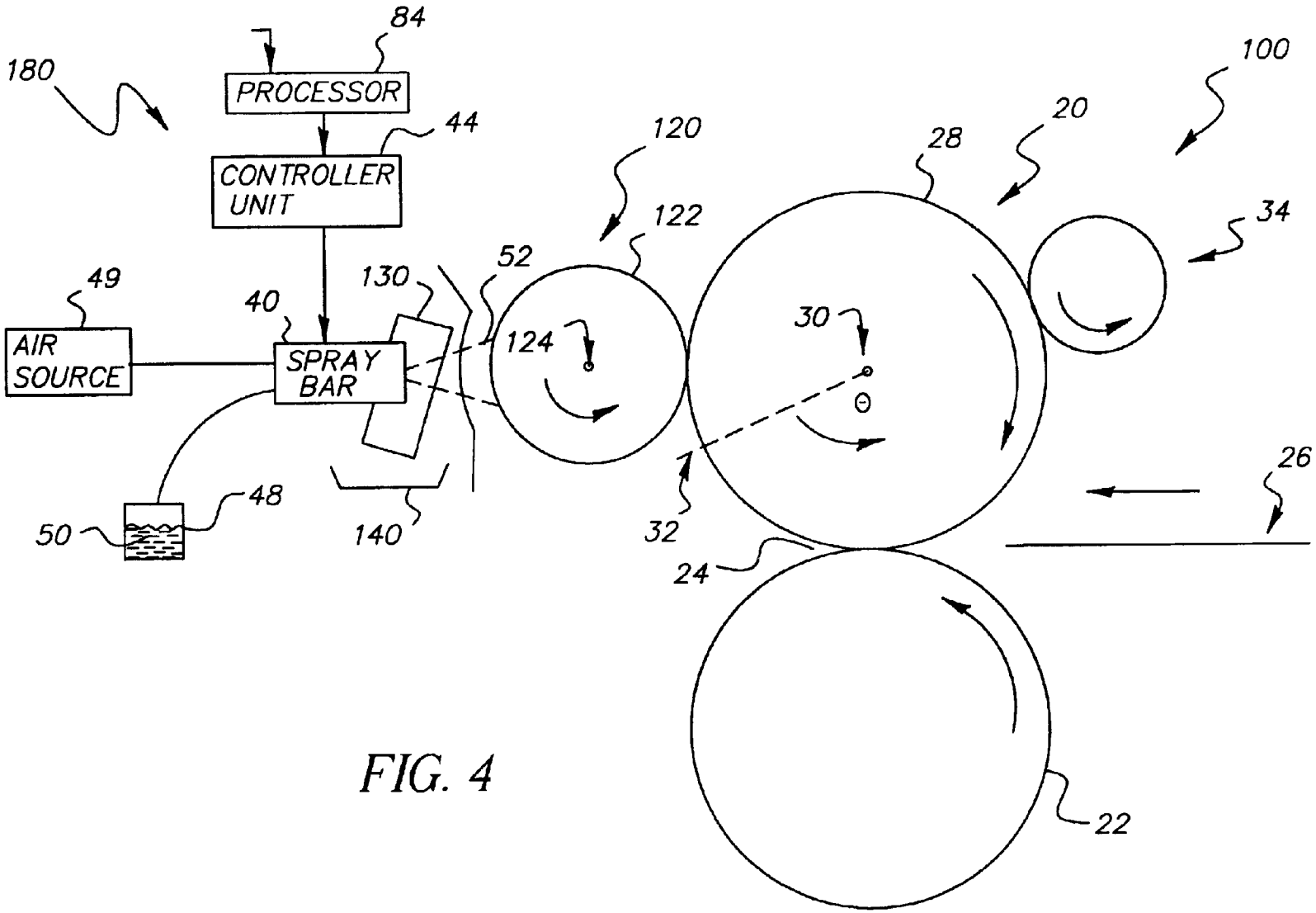
FIG. 4 illustrates an alternate embodiment of the invention as shown in FIG. 1.

An alternate embodiment of the invention is illustrated in FIG. 4 wherein like reference numerals denote like features illustrated in other figures. A fuser apparatus 100 for image reproduction system includes a fuser roller 20 and an elastomeric pressure roller 22 which form a nip 24 through which a substrate 26 comes in contact with the fuser roller surface 28 to affix a toner image thereon. The fuser apparatus 100 further includes a roller 120 having a surface 122 in rolling contact with the fuser roller surface 28. It is to be understood that the surface 122 of the roller 120 is cylindrically shaped about an axis of rotation 124. A spray bar 40, such as previously described with reference to FIG. 1 and FIG. 2, is positioned adjacent, and in spaced-apart relation to, the surface 122 of the roller 120. A reservoir 48 containing an offset preventing, silicone-based release oil 50 supplies such oil to the spray bar 40 for distribution of the oil to each microspray device 42. As previously described, the reservoir may be coupled to a low pressure air source to deliver the oil 50.

With reference to a clockwise motion of the fuser roller 20 as shown in FIG. 4, the roller 120 is positioned to receive the oil 50 directly from the spray bar 40 as it turns in a counterclockwise direction. The fuser roller 20 then receives the oil 50 from the roller 120. Next, the distribution of oil 50 applied to the fuser surface may be smoothed by the roller 34 before reaching the nip 24. Application of the oil 50 to the surface 28 is coordinated with the substrate 26 so that selected portions of the substrate come into contact with selected amounts of oil on various portions of the fuser roller surface. A release agent fluid management system 180, according to this invention, similar to that fully described with the embodiment of FIGS. 1 and 2, effects the variation in oil application dependent upon image reproduction operating parameters in substantially the same manner.

A release agent fluid management system and associated processes according to this invention have been described for improved image reproduction. The invention mitigates multiple problems known to affect image quality and image reproduction costs. Specifically, the fuser apparatus 10 will not suffer from the characteristic release agent fluid (oil) surges, i.e., excessive oil transfer rates, of conventional oiler systems. With a release agent fluid management system that does not employ a wick or roller surface to transfer oil from a sump to the fuser roller, many of the variables adversely affecting uniformity of release agent fluid distribution are no longer present. Furthermore, with the greater control now available for selectively dispensing the oil to the fuser roller surface 28, it is possible to account for other variations which could degrade image quality, including changes in oil viscosity as a function of temperature and changes in toner density as a function of position on the substrate surface. The invention thus enables a form of "matrix oiling", that is, based on the toner image content, oil can be variably dispensed among zones on the substrate toner image fusing according to the amounts of release agent fluid needed. According to the invention, variations in matrix oiling can be on a sheet-by-sheet basis.

Another advantage of the invention is the economical application of the release agent fluid without recirculation.

Thus, there is less opportunity to introduce contaminants. Still another advantage of the invention is better control over the amount of oil used in fixing the image and this results in an overall reduction in the amount of release agent fluid dispensed. Advantageously, the oil delivery rate can be controlled by altering the pulse rate or duration of the spray 52 in consideration of changes in media type (e.g., coated vs. uncoated and transparencies vs. bond paper). For example, it is desirable to provide less release agent (e.g., 2 to 4 mg less per sheet of A4 paper) for coated paper than for uncoated paper. Another advantage is that less oil comes into the electrophotographic process when second side imaging is performed in a two-pass printer configuration. This reduction in the amount of fuser release oil coming back into the process further reduces oil-induced image quality artifacts.

It is also possible for the release agent fluid management system, according to the invention, to selectively enable, disable, or modify spray characteristics from certain of the microspray devices 42, as an example, referenced as 42*a* and 42*b* in FIG. 2, to minimize oil rate edge bleed and to accommodate paper sizes of differing widths (i.e., the distance measured along the roller axis). That is, spray overlap is controllable in regions near the edge of the substrate surface and oil application can be minimized or eliminated in regions of the fuser roller surface 28 that do not come into contact with the substrate 26 based on the substrate width. Similarly, with the processor 84 receiving information determinative of circumferential length about the fuser roller surface coming into contact with each substrate, the controller 44 can be directed to cease spraying the oil 50 in the regions about the fuser roller circumference which will not come into contact with the substrate 26.

Figure 5A:
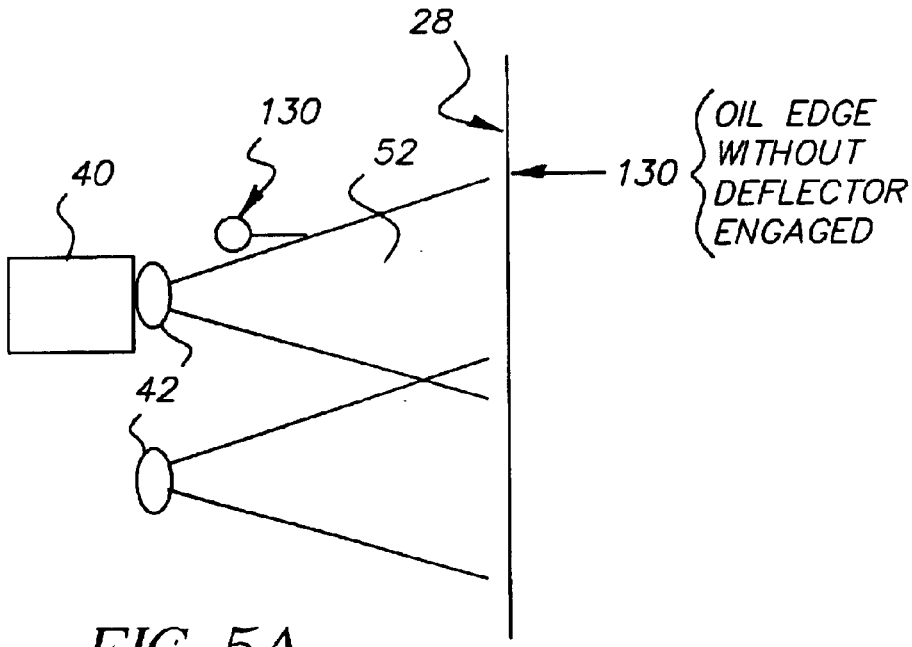
FIGS. 5A and 5B provide plan views of the embodiment of the invention shown in FIG. 4.
Figure 5B:
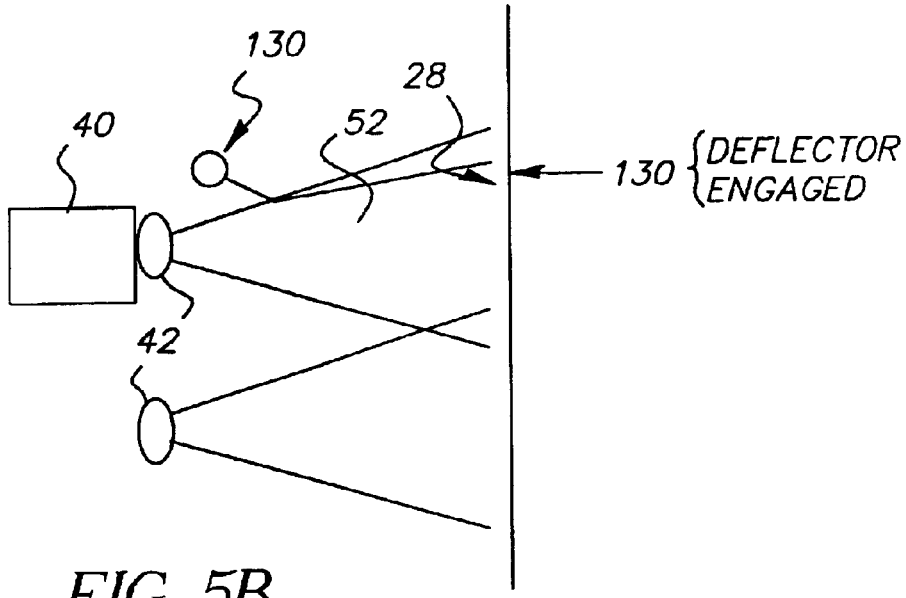

It is to be understood that the ability of the release agent fluid management systems disclosed herein to optimize for given paper widths will be a function of the number of microspray devices 42 per unit length along the spray bar 40. As an additional accommodation, useful when it is not economical to optimize for small differences in paper width (e.g., 11 inch vs. 11.7 inch), the configuration of the spray bar 40 may be optimized for one of the two widths and the system may selectively deploy spray deflectors 130, (see FIG. 4) to direct edge flow when a substrate having the smaller of the two widths is being processed, with an oil catch tray 140 positioned to receive the deflected oil. The plan view of FIG. 5A illustrates a deflector 130 positioned outside of the effective area of a spray 52 while a substrate having the larger of the two widths is processed. The plan view of FIG. 5B illustrates the same deflector 130 actively positioned, e.g., via a suitable solenoid or pneumatic mechanism, to intersect the spray 52 while a substrate having the smaller of the two widths is processed. As a result, the angle of the spray 52 is reduced to prevent undesirable placement of the release oil 50 directly on the fuser roller surface 28.

By way of example and not limitation, the invention has been described in conjunction with image reproduction systems that employ fuser rollers. Moreover, the invention may be practiced in fuser apparatus that employ belt fusers as well. See FIG. 6 which illustrates, in simplified schematic form, another image reproduction system fuser apparatus 300 having an endless fuser belt 304, a heating roller 306, a back up roller 312, and an unheated idler roller 308. A surface 328 of the belt 304 rotates around the rollers in the direction indicated by arrow 320. The backup roller 312 presses against the belt 304, and the heating roller 306 to provide a nip therebetween. In operation, a substrate 26 moves in the direction of the adjacent arrow through the nip between the belt 304 and the backup roller 312 and thereby enters a fusing zone. Other details relating to this belt fuser design are described in U.S. Pat. No. 6,010,791 incorporated herein by reference.

Figure 6:
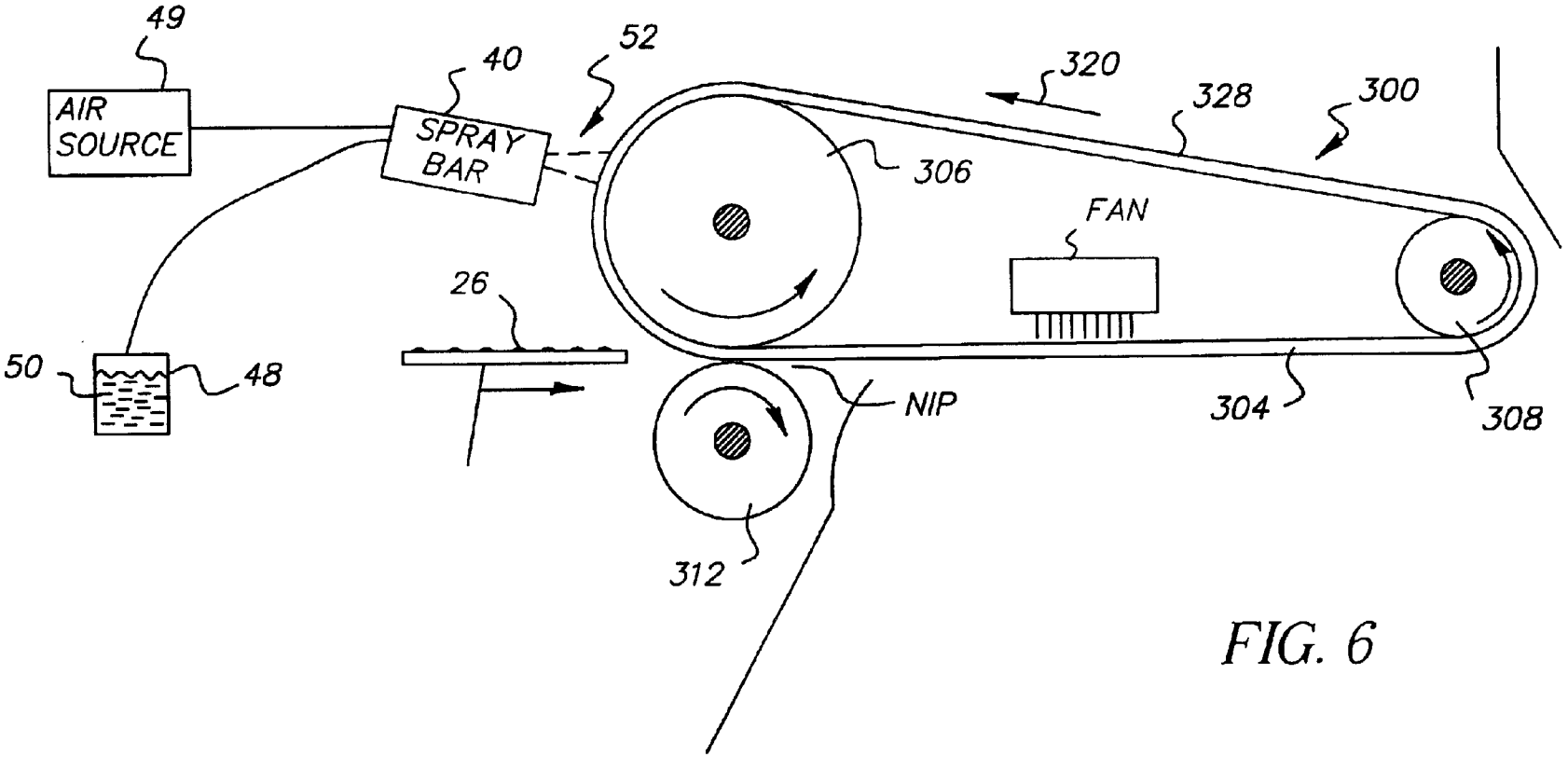
FIG. 6 illustrates still another embodiment of the invention as shown in FIG. 1.

In accordance with the present invention, the fuser apparatus 300 of FIG. 6 includes a release agent fluid management system 380, which has a spray bar 40, including microspray devices, and a controller unit 44 such as described with reference to FIG. 1. The spray bar 40 is positioned adjacent, and in spaced-apart relation to, the portion of the belt 304 passing about the heating roller 306.

A reservoir 48 containing an offset preventing, silicone-based release oil 50 supplies such oil to the spray bar 40 for distribution of the oil to each microspray device. The reservoir may be coupled to a low pressure, (e.g., one bar) air source 49 to deliver the oil 50 through the microspray devices to the fuser belt surface 328 in desired patterns. A flat-pattern orifice is suitable for this purpose. The release agent fluid management system 380, further includes a processor and control unit, as described with reference to the previous embodiments, to regulate oil variation, according to this invention, based on various image reproduction operating parameters.

Exemplary embodiments have been disclosed while other embodiments of the invention will be apparent. It is also to be understood that while specific mechanisms or configurations have been described to effect specific purposes, other mechanisms or configurations will be apparent to those skilled in the art to accomplish the same or similar purposes. Also, while the disclosed embodiments illustrate the fuser rotating in a clockwise direction with other components moving in a counter-clockwise direction, opposite configurations are contemplated as well.

With only select embodiments of the invention having been illustrated, it will be apparent to those skilled in the art that numerous additions, deletions, and modifications may be had without departing from the spirit of the invention and thus the invention may be practiced in a variety of ways, such that the scope of the invention is only limited by the claims which now follow.

What is claimed is:

1. A release agent fluid management system for a fuser apparatus of an image reproduction apparatus operating according to predetermined operating parameters, said fuser apparatus having a heated surface that travels in a first direction and contacts a toner image on a substrate for fixing the toner to the substrate, said release agent fluid management system comprising:

a spray device, disposed transverse to the direction of travel of the fuser heated surface, selectively operable to dispense release agent fluid to selected regions on said heated surface of said fuser to prevent toner particles from adhering to said heated surface, said spray device including an array of microspray nozzles disposed transverse to the path of said heated surface, each nozzle being adjustable as to the spray angle and time for operation; and a controller coupled to said spray device for controlling the operation thereof to adjust amounts of release agent fluid dispensed as a function of signals indicative of one or more image reproduction operating parameters.

2. The release agent fluid management system of claim 1, wherein said fuser is a heated roller or a heated belt.

3. The release agent fluid management system of claim 1, further comprising deflector bars at opposite ends of said array of microspray nozzles and operable to adjust the angle of the spray at the ends of said array.

4. The release agent fluid management system of claim 1, further comprising a reservoir for holding a supply of release agent fluid and a source of pressurized air selectively connectable to said nozzles to atomize the release agent fluid.

5. A fuser apparatus, for an image reproduction apparatus, for fusing a toner image on a substrate, said fuser apparatus comprising:

a roller having a cylindrically shaped surface formed about an axis of rotation, the surface having a plurality of positions definable by angular position about the axis and measurement in an axial direction along the surface; and a release agent fluid management system configured to controllably apply release agent fluid to said roller surface as a function of measurement along said roller surface in the axial direction, said release agent fluid management system including a selectively actuatable spray device, including a plurality of individually controllable microspray devices each configured to selectively apply release agent fluid to a portion of the fuser surface, and a processor system coupled to said plurality of microspray devices for variably controlling the amount of fluid release agent applied to said roller surface at a programmable selectable rate as a function of signals from said process system indicative of one or more image reproduction operating parameters.

6. The fuser apparatus of claim 5, wherein said release agent fluid management system includes an atomization air source configured to distribute selectable and differing amounts of release agent fluid upon different portions of said roller surface according to signals received from said processor system.

7. The fuser apparatus of claim 5, wherein said signals indicative of one or more reproduction operating parameters include data taken from the group consisting of substrate dimension, substrate type, image density, image position, one or two sided printing, fuser temperature and release agent viscosity.

8. The fuser apparatus of claim 5, wherein said release agent fluid management system is configured to controllably apply release fluid among positions on said roller surface as a function of angular position about the axis of said roller surface and along said roller surface in the axial direction.

9. The fuser apparatus of claim 5, wherein variation in release agent fluid application to said roller surface by said processor system is synchronized with movement of said substrate relating to said roller surface.

10. The fuser apparatus of claim 5, wherein said processor system varies the amount of release agent fluid applied to portions of roller surface as a function of the amount of toner in an image reproduction coming into contact with each such roller surface portion.

11. The fuser apparatus of claim 5, wherein said roller is a fuser roller.

12. The fuser apparatus of claim 5, wherein said roller is positioned to apply release agent fluid directly to a heated fuser member of said fuser apparatus.

13. The fuser apparatus of claim 5, further including a heating roller rotatable about its axis of rotation, and an endless belt positioned to move about such axis with rotation of said heating roller.

* * * * *